US011167199B2

(12) United States Patent
Avguštin et al.

(10) Patent No.: US 11,167,199 B2
(45) Date of Patent: Nov. 9, 2021

(54) FOLDING SKI

(71) Applicant: ELAN, d.o.o., Begunje na Gorenjskem (SI)

(72) Inventors: Vinko Avguštin, Žirovnica (SI); Andrej Hrovat, Radovljica (SI)

(73) Assignee: ELAN, d.o.o., Begunje na Gorenjskem (SI)

( * ) Notice: Subject to any disclaimer, the term of this patent is extended or adjusted under 35 U.S.C. 154(b) by 0 days.

(21) Appl. No.: 16/753,496

(22) PCT Filed: Sep. 24, 2018

(86) PCT No.: PCT/IB2018/057350

§ 371 (c)(1),
(2) Date: Apr. 3, 2020

(87) PCT Pub. No.: WO2019/092513

PCT Pub. Date: May 16, 2019

(65) Prior Publication Data

US 2020/0289912 A1 Sep. 17, 2020

(30) Foreign Application Priority Data

Nov. 8, 2017 (SI) ..... P-201700295

(51) Int. Cl.
*A63C 5/02* (2006.01)

(52) U.S. Cl.
CPC ..... *A63C 5/02* (2013.01); *A63C 2203/10* (2013.01)

(58) Field of Classification Search
CPC ..... A63C 5/02; A63C 2203/10
See application file for complete search history.

(56) References Cited

U.S. PATENT DOCUMENTS 3,801,117 A * 4/1974 Pierce ..... A63C 5/02 280/603
4,130,296 A * 12/1978 D'Antonio ..... A63C 9/005 280/607

(Continued)

FOREIGN PATENT DOCUMENTS

EP 2 856 898 A1 4/2015
EP 2 999 525 B1 2/2017

(Continued)

OTHER PUBLICATIONS

International Search Report issued in PCT/IB2018/057350; dated Jan. 3, 2019.

*Primary Examiner* — James A Shriver, II
*Assistant Examiner* — Michael T. Walsh
(74) *Attorney, Agent, or Firm* — Studebaker & Brackett PC

(57) ABSTRACT

A folding ski for sporting or military purposes. The technical problem is how to conceive a functional ski without a retaining projection with a latching mechanism arranged at the front end of the ski front section, which projection is used to fasten a connecting platform in the folded state of the ski. The folding ski includes a ski front section, a ski rear section, a folding connection that inseparably connects the rear end of the ski front section with the front end of the ski rear section, a connecting platform that is intended to stiffen the folding connection and is pivotal around its axis of rotation that extends perpendicularly to the upper surface of the ski, wherein the connecting platform is directly pivotally connected with the ski front or rear section.

11 Claims, 4 Drawing Sheets

(56) References Cited

U.S. PATENT DOCUMENTS

Figure 1:
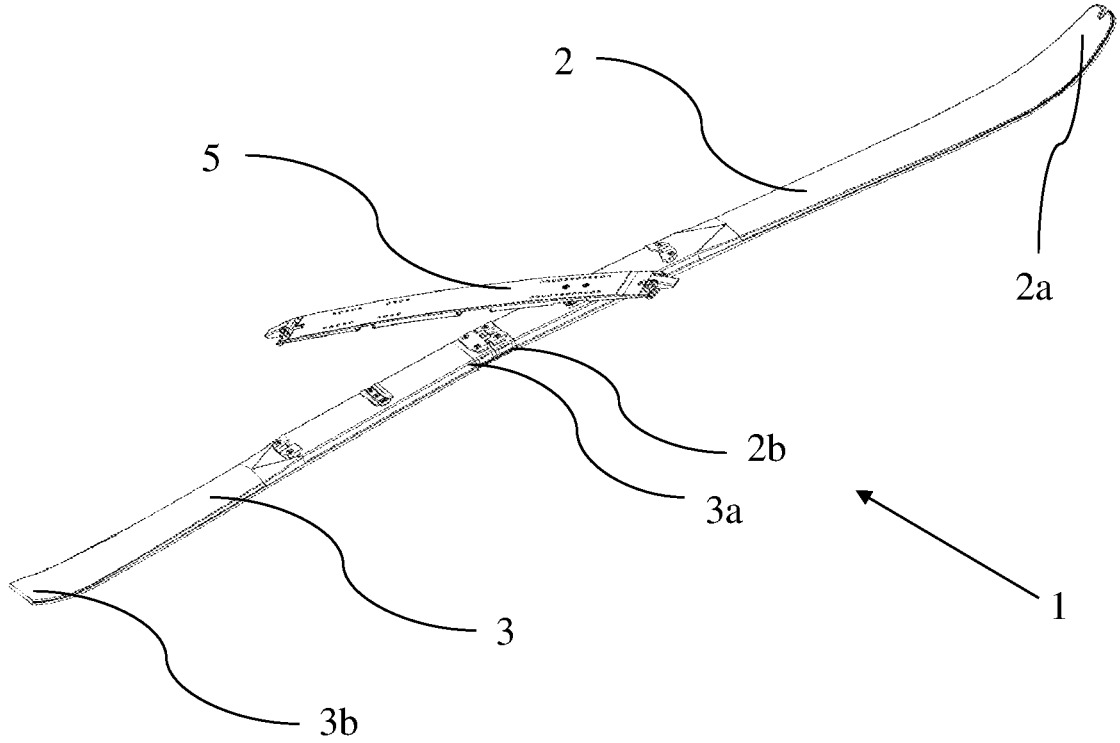

| | | | | | |
|---|---|---|---|---|---|
| 4,230,351 | A * | 10/1980 | Bisbing | E05C 3/08 | 292/223 |
| 4,405,150 | A * | 9/1983 | Esper | A63C 5/02 | 280/603 |
| 4,593,926 | A * | 6/1986 | Pergola | A63C 5/02 | 280/603 |
| 5,141,243 | A * | 8/1992 | Meatto | A63C 5/07 | 280/602 |
| 2003/0193220 | A1* | 10/2003 | Jensen | B60N 3/004 | 297/146 |
| 2013/0106068 | A1* | 5/2013 | Franko | A63C 17/062 | 280/11.15 |
| 2016/0107068 | A1* | 4/2016 | Avgustin | A63C 5/02 | 280/603 |
| 2018/0265013 | A1* | 9/2018 | Beznes | A01K 97/10 | |

FOREIGN PATENT DOCUMENTS

| | | | | | |
|---|---|---|---|---|---|
| SI | 25117 | A | 7/2017 | | |
| WO | 01/97929 | A2 | 12/2001 | | |
| WO | WO-0197929 | A2 * | 12/2001 | A63C 9/00 | |
| WO | 2017/131590 | A1 | 8/2017 | | |
| WO | WO-2017131590 | A1 * | 8/2017 | A63C 9/003 | |

* cited by examiner

FOLDING SKI

FIELD OF INVENTION

The invention refers to a folding ski for sporting or military purposes.

PRIOR ART

A folding ski is known from prior art. When assembled, a folding ski functions as a classic ski, its advantage being its possibility of being folded and is as such more handy for carrying, transporting, and storing. A collapsible ski is disclosed in patent SI 25117. In its functional state, the ski comprises a ski front section having a front end with a tip bent upwards from the base and a rear end, a ski rear section having a front end and a rear end with a tail slightly bent upwards, wherein the rear end of the ski front section is inseparably connected with the front end of the ski rear section by means of a folding connection. The folding connection is stiffened by a connecting platform engaging semi-circular grooves formed on the ski front and rear sections. It is desirable that all ski parts are inseparably connected to each other; this is why the connecting platform is foldably connected with one end of the connecting plate, the latter being hingedly connected with its other end with the ski front section. The upper portion of the connecting platform is provided with bindings for fastening a ski boot. To prevent rotation of the connecting platform around the hinged connection while the ski is in use, both the ski front and the rear sections are provided with two retaining projections with a latching mechanism. The retaining projection with the latching mechanism on the ski front section also serves to fasten the connecting platform when the ski is in its folded state.

Modern design is oriented towards smooth surfaces and lines. This is why the retaining projection with the latching mechanism is considered as a disturbance from the aesthetic point of view. It is particularly disturbing when the ski is used for military purposes. While performing military activities, a soldier on the skis, when assuming a shooting position, kneels with one leg on the ski and the retaining projection with the latching mechanism hurts his knee.

Technical Problem

The technical problem is how to conceive a ski that would have all the above-indicated functionalities yet without the retaining projection with the latching mechanism arranged at the front end of the ski front section.

Solution to the Technical Problem

The relative expressions such as front, rear, upper, lower, etc. are herein defined from the perspective of the ski user, when the ski is in its functional state.

The technical problem is solved by a folding ski that comprises:

- a ski front section having a front end with a tip slightly bent upwards and a rear end,
- a ski rear section having a front end and a rear end with a tail slightly bent upwards,
- a folding connection that inseparably connects the rear end of the ski front section with the front end of the ski rear section,
- a connecting platform that is intended to stiffen the folding connection of the ski in its functional state and is pivotal around its folding axis that extends perpendicularly to the upper surface of the ski, wherein the connecting platform is directly hingedly connected with the ski front and rear sections and arranged such that the transversal middle axis of the connecting platform in the functional state of the ski is located in the area of the folding connection, wherein the connecting platform is provided at a first end with a first tongue in the form of a circular arc and at a second end with a second tongue in the form of a circular arc, wherein both circular arcs are formed with a radius originating in said folding axis, wherein the connecting platform in the functional state of the ski engages with the first and second tongues a respective first and second groove that are formed in the ski front and rear sections, wherein the grooves are formed with a circular arc that matches the circular arc of each tongue, and wherein the connecting platform is arranged and sized such that the first end of the connecting platform in the folded state of the ski is arranged proximal to the folding connection, and the connecting platform engages with the first tongue at the first end of the connecting platform a third groove in the form of a circular arc, which is complementary to the first tongue and arranged on the ski front or rear section proximal to the folding connection.

An advantage of the invention over known solutions is the fact that the ski lacks a retaining projection with a latching mechanism at the front end of the ski front section. A further advantage of the solution of the invention over the solution known from prior art lies in that a direct hinged connection of the connecting platform with the ski front section provides for a stiffer connection between the connecting platform and the ski front section and consequently for a smoother bending line of the ski, i.e. a more equal distribution of forces.

FIG. 1: Folding ski with a connecting platform

Figure 2:
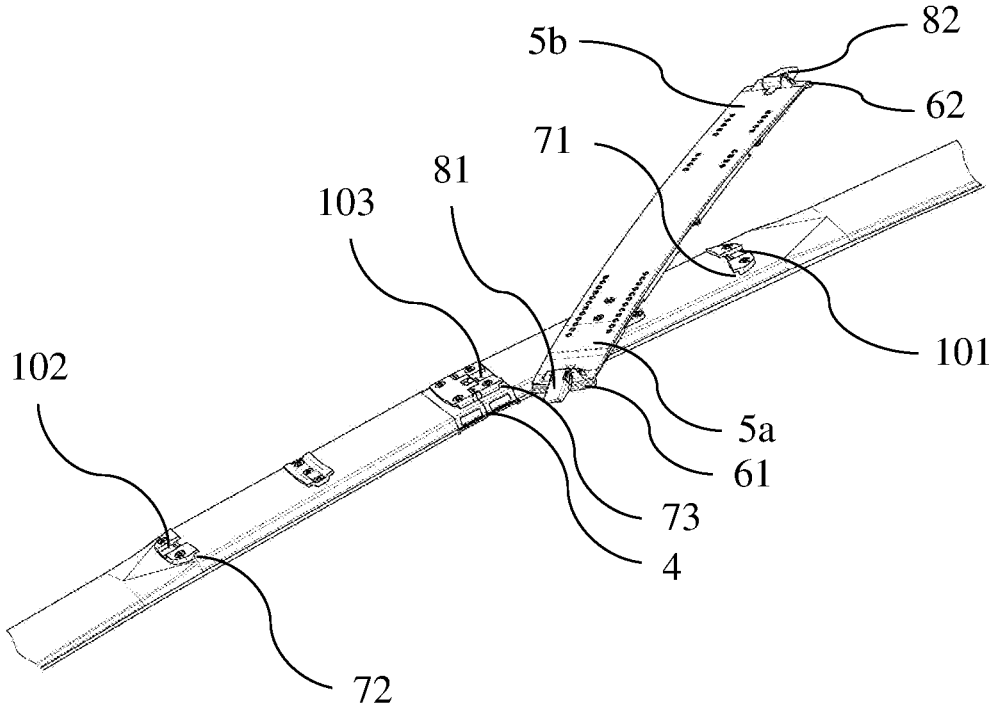
Figure 3:
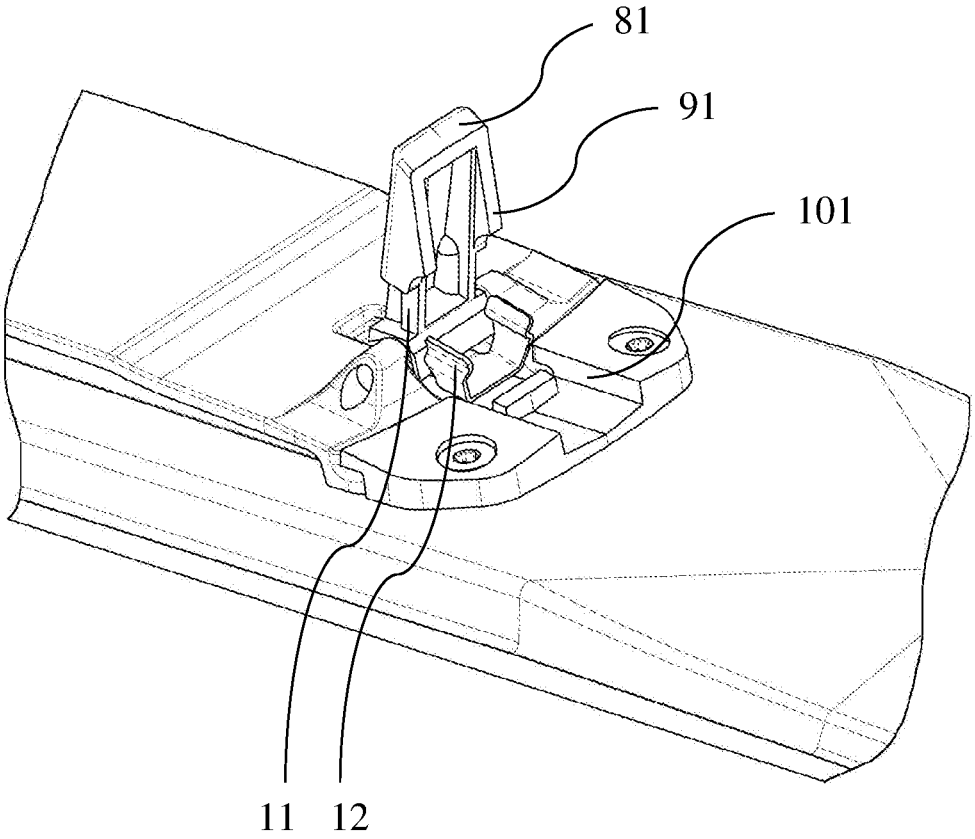
Figure 4:
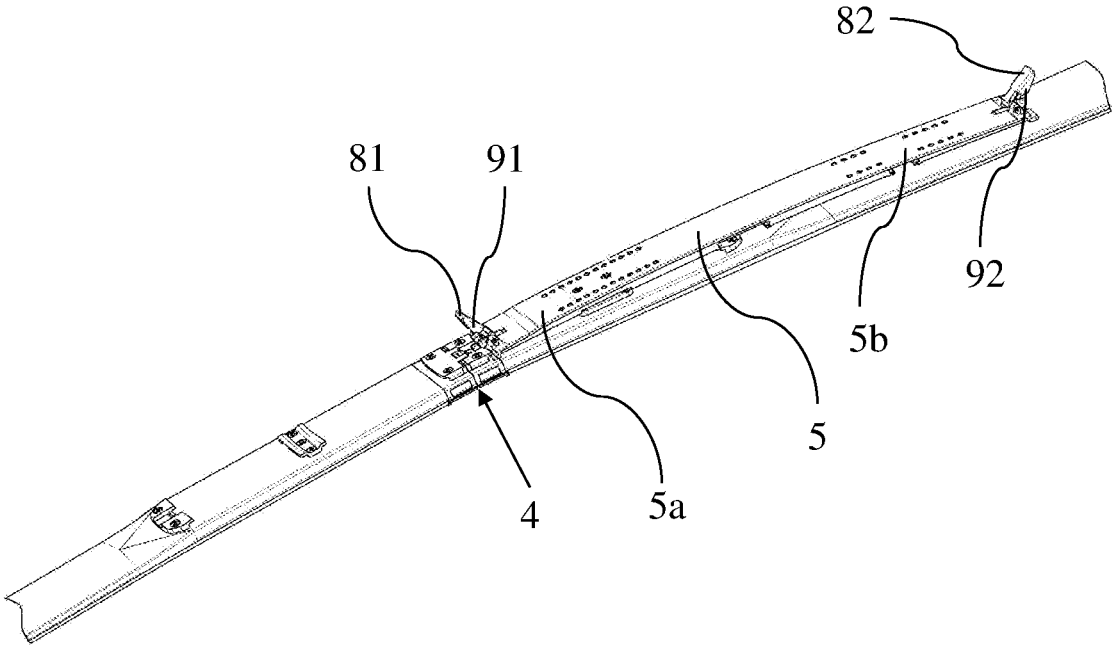
Figure 5:
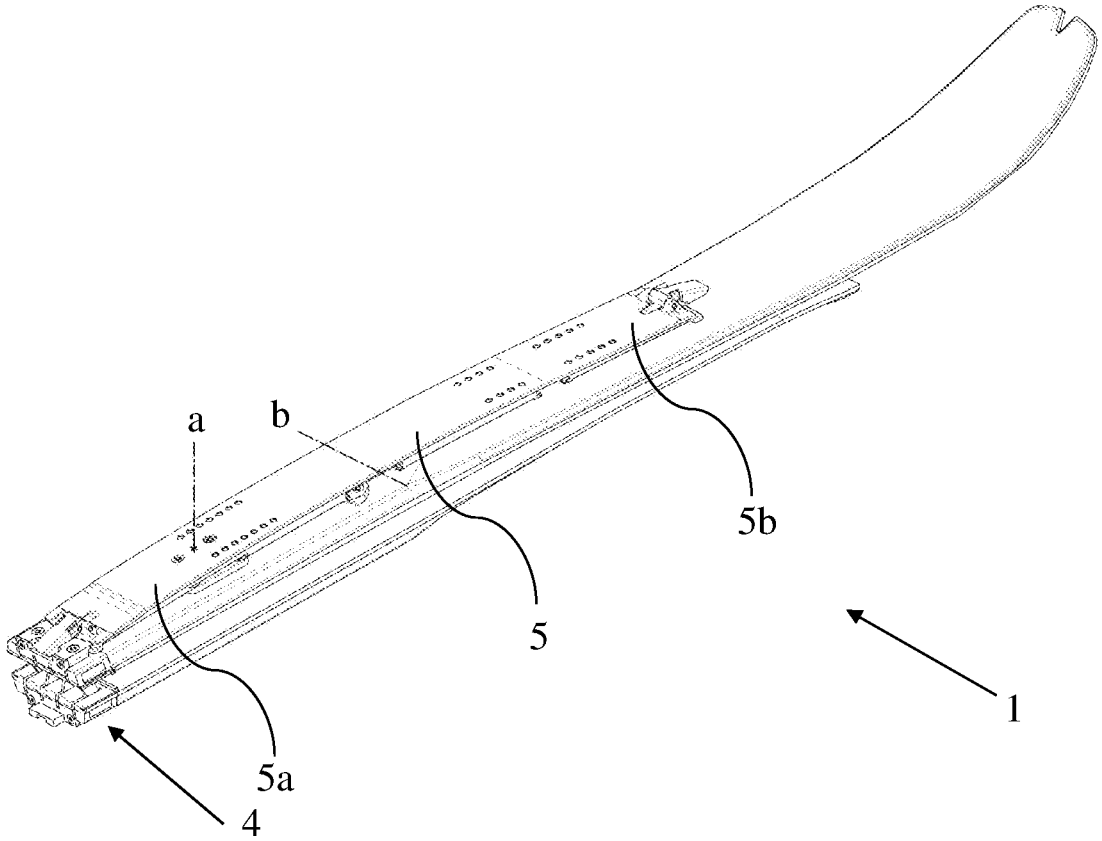
Figure 6:
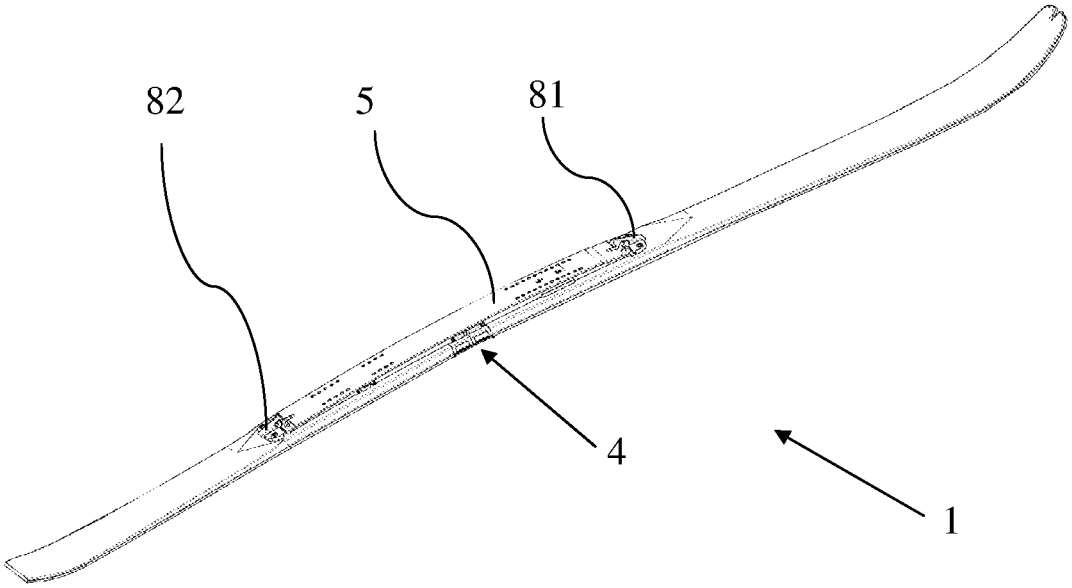
Figure 7:
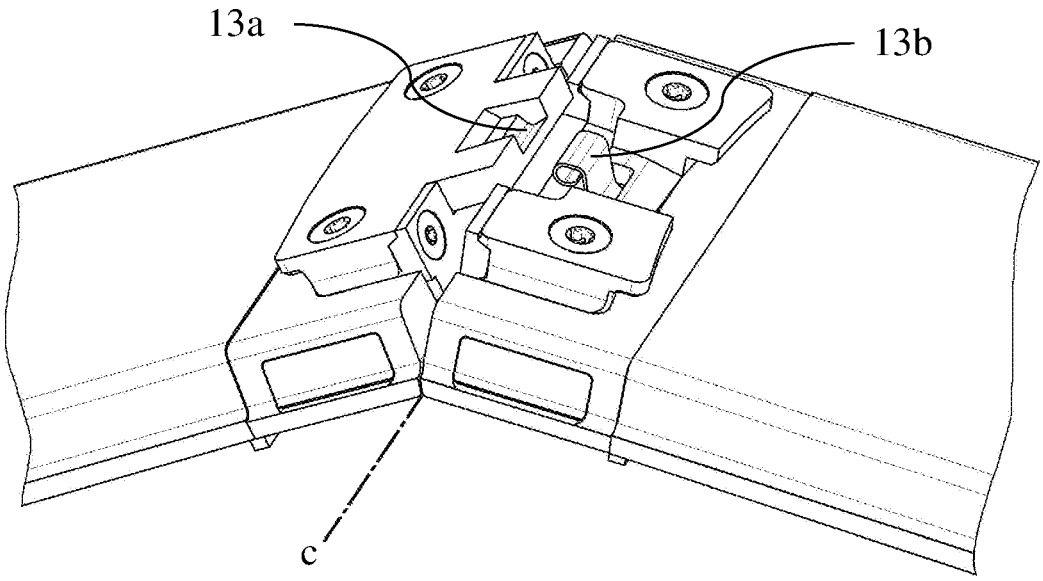
Figure 8:
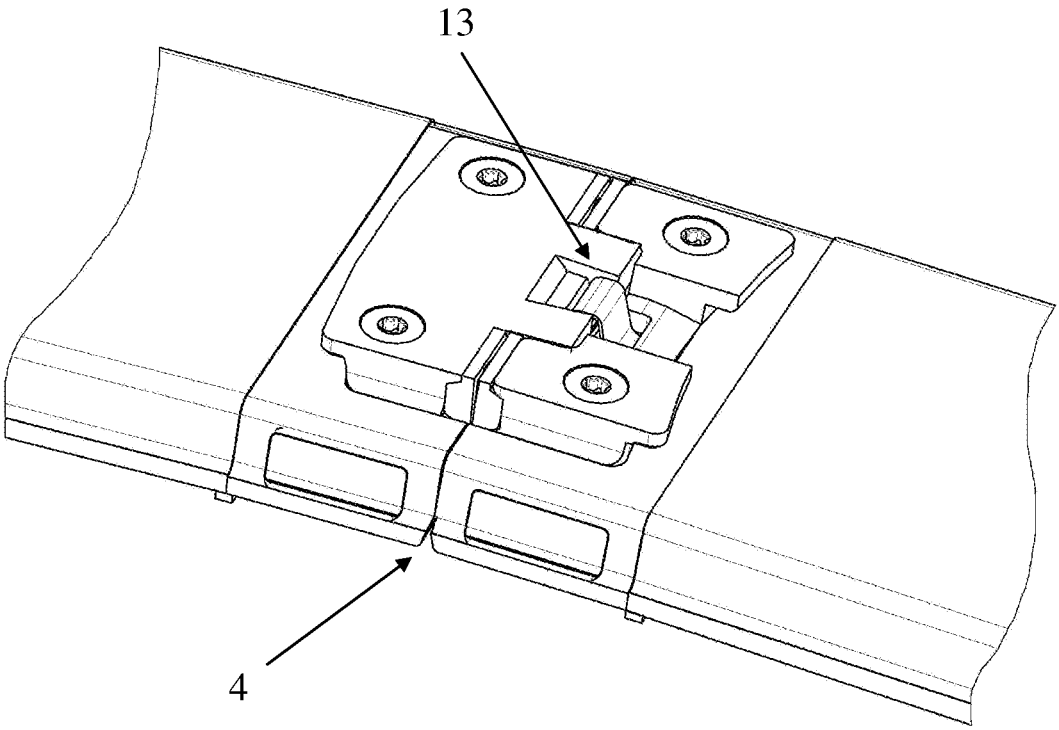

FIG. 2: Folding ski with indicated tongues and grooves for the connection of the folding ski with the connecting platform FIG. 3: Clip for fastening the connecting platform FIG. 4: Folding ski with clips in an unfastened state FIG. 5: Folding ski in a folded state FIG. 6: Folding ski in a functional state FIG. 7: Folding connection of the folding ski with a latching mechanism FIG. 8: Folding connection of the folding ski in a latched state The invention is described in more detail hereinbelow.

The technical problem is solved by a folding ski 1 that comprises:

- a ski front section 2 having a front end 2*a* with a tip slightly bent upwards and a rear end 2*b*,
- a ski rear section 3 having a front end 3*a* and a rear end 3*b* with a tail slightly bent upwards,
- a folding connection 4 that inseparably connects the rear end 2*b* of the ski front section with the front end 3*a* of the ski rear section,
- a connecting platform 5 that is intended to stiffen the folding connection 4 of the ski in its functional state and is pivotal around its axis of rotation a that extends perpendicularly to the upper surface of the ski, wherein the connecting platform is directly pivotally connected with the ski front 2 and rear 3 sections and arranged such that the transversal middle axis b of the connecting platform 5 in the functional state of the ski is located in the area of the folding connection 4, wherein the connecting platform is provided at a first end 5*a* with a first tongue 61 in the form of a circular arc and at a second end 5*b* with a second tongue 62 in the form of a circular arc, wherein both circular arcs are formed with a radius originating in said axis a of rotation, wherein the connecting platform 5 in the functional state of the ski engages with the first 61 and second 62 tongues a respective first 71 and second groove 72 that are formed in the ski front 2 and rear 3 sections, wherein the grooves 71, 72 are formed with a circular arc that matches the circular arc of each tongue, and wherein the connecting platform 5 is arranged and sized such that the first end 5*a* of the connecting platform in the folded state of the ski is arranged proximal to the folding connection 4, and the connecting platform with the first tongue 61 at the first end of the connecting platform engages a third groove 73 in the form of a circular arc, which is complementary to the first tongue 61 and arranged on the ski front 2 or rear 3 section proximal to the folding connection 4.

The connecting platform 5 further comprises a first clip 81 formed with at least one first projection 91 that can engage, in the folded state of the ski, with at least one third recess 103 formed on the ski front 2 or rear 3 sections proximal to the folding connection 4, wherewith the rotation of the connecting platform 5 around the axis a of rotation in the folded state of the ski is prevented.

In the functional state of the ski, the first clip 81 provided with at least a first projection 91 can engage at least a first recess 101 formed on the ski front 2 or rear 3 sections, wherewith the rotation of the connecting platform 5 around the axis a of rotation in the functional state of the ski is prevented.

The connecting platform 5 can further comprise a second clip 82 formed with at least one second projection 92 that can engage, in the functional state of the ski, at least one second recess 102 formed on the ski rear 3 or front 2 sections.

The clip 81, 82 can be provided with at least one step 11 that engages a spring element 12 in the operative state of the clip, wherewith an inadvertent opening of the clip is prevented, which is particularly important during skiing. The clip can be activated/deactivated with one hand only.

The connecting platform 5 can be made of aluminium. Alternatively, the connecting platform can be made from injection moulded plastics reinforced with fibres, particularly carbon fibres or glass fibres. The connecting platform can further be reinforced with a fabric layer from fibres, particularly carbon fibres or glass fibres. The advantage of the plastic connecting platform over the aluminium one is more than halved mass of the connecting platform. A further reduction in the mass of the connecting platform 5 is achieved by longitudinal grooves formed in its bottom side. If the connecting platform is made of aluminium, the grooves are made by milling, which is time consuming and cost inefficient. If the platform is made of plastics, the grooves are formed in the tool already and further processing is not necessary.

To achieve an as smooth bending line of the ski as possible and as stiff connection between the ski and the connecting platform 5 in the functional state of the ski, the connecting platform is preferably connected with the ski with as many tongue-and-groove connections as possible and these connections should be equally distributed along the length of the connecting platform. Very desirably, this connection should be present also in the area of the folding connection 4 of the ski front 2 and rear 3 sections.

The folding connection 4 between the ski front and rear sections may be provided with a latching mechanism 13 that stiffens the connection in the functional state of the ski. The latching mechanism 13 can be formed by a recess 13*a* and a spring 13*b* that clips into the recess 13*a* when the ski is in the functional state. This is of particular importance when the ski is assembled to a functional state in the field when the user has not flat surface available. In assembling the ski, the ski is first pivoted around the folding axis c to the extended position, the connecting platform is subsequently pivoted around the axis a of rotation from the folded into the functional state. If the ski is not in its fully extended position, some tongue-and-groove connections might not be well established or more effort is needed for their establishment. When assembling the ski, the latching mechanism 13 maintains the ski in its completely extended position, which contributes to an easier establishment of connections between the grooves of the connecting platform and the tongues of the ski.

The invention claimed is:

1. A folding ski comprising:

a ski front section having a front end with a tip slightly bent upwards and a rear end, a ski rear section having a front end and a rear end with a tail slightly bent upwards, a folding connection inseparably connecting the rear end of the ski front section with the front end of the ski rear section, a connecting platform stiffening the folding connection of the ski in its functional state and is pivotal around its axis of rotation that extends perpendicularly to the upper surface of the ski, wherein the connecting platform is arranged such that the transversal middle axis of the connecting platform in the functional state of the ski is located in the area of the folding connection, wherein the connecting platform is provided at a first end with a first tongue in the form of a circular arc and at a second end with a second tongue in the form of a circular arc, wherein both circular arcs are formed with a radius originating in said axis of rotation, wherein the connecting platform in the functional state of the ski engages with the first and second tongues a respective first and second groove that are formed in the ski front and rear sections, wherein the grooves are formed with a circular arc that matches the circular arc of each tongue, and wherein the connecting platform is arranged and sized such that the first end of the connecting platform in the folded state of the ski is arranged proximal to the folding connection, and the connecting platform with the first tongue at the first end of the connecting platform engages a third groove in the form of a circular arc, which is complementary to the first tongue and arranged on the ski front or rear section proximal to the folding connection, the connecting platform being directly pivotally connected with the ski front or rear section.

2. The folding ski according to claim 1, wherein the connecting platform includes a first clip formed with at least one first projection that engages, in the folded state of the ski, at least one third recess formed on the ski front or rear section proximal to the folding connection.

3. The folding ski according to claim 1, wherein characterized the connecting platform includes a second clip formed with at least one second projection that engages, in the functional state of the ski, at least one second recess formed on the ski rear or front section.

4. The folding ski according to claim 2, wherein the clip is provided with at least one step that engages a spring element in the operative state of the clip.

5. The folding ski according to claim 1, wherein longitudinal grooves are formed in the connecting platform on its bottom side.

6. The folding ski according to claim 1, wherein the connecting platform is made from aluminium.

7. The folding ski according to claim 1, wherein the connecting platform is made from injection moulded plastics reinforced with fibres.

8. The folding ski according to claim 7, wherein the connecting platform is reinforced with a fabric layer from fibres.

9. The folding ski according to claim 1, wherein a plurality of tongues in the form of a circular arc are arranged along the connecting platform, said tongues to engage the grooves arranged on the ski in the functional state of the ski.

10. The folding ski according to claim 1, wherein the folding connection is provided with a latching mechanism.

11. The folding ski according to claim 10, wherein the latching mechanism is formed by a recess and a spring.

* * * * *